US005535776A

United States Patent [19]

Kingman

[11] Patent Number: 5,535,776

[45] Date of Patent: Jul. 16, 1996

[54] KITCHEN FAUCET TOP MOUNT DEVICE

[75] Inventor: Ross E. Kingman, Elyria, Ohio

[73] Assignee: Moen Incorporated, North Olmsted, Ohio

[21] Appl. No.: 441,068

[22] Filed: May 15, 1995

[51] Int. Cl.[6] ..... F16L 5/00

[52] U.S. Cl. ..... 137/359; 137/801

[58] Field of Search ..... 137/359, 801; 4/675, 676, 678

[56] References Cited

U.S. PATENT DOCUMENTS

| | | | |
|---|---|---|---|
| 3,669,141 | 6/1972 | Schmitt . | |
| 4,186,761 | 2/1980 | Guarnieri . | |
| 4,262,699 | 4/1981 | Fabion | 137/801 |
| 4,502,165 | 3/1985 | Szemeredi et al. | 137/801 |
| 4,553,277 | 11/1985 | Duncan . | |
| 4,848,395 | 7/1989 | Krippendorf . | |
| 5,010,922 | 4/1991 | Agresta . | |

FOREIGN PATENT DOCUMENTS

| | | | |
|---|---|---|---|
| 511420 | 8/1955 | Italy | 137/359 |

*Primary Examiner*—A. Michael Chambers
*Attorney, Agent, or Firm*—Dorn, McEachran, Jambor & Keating

[57] ABSTRACT

A device for the top mounting of a faucet to a sink includes a generally cylindrical sleeve having a threaded shank with an internal diameter of a size to receive the body of a faucet and the water connections thereto. The sleeve has an outwardly extending shoulder at one end and an upstanding wall at the extremity of the shoulder. The shoulder is formed and adapted to seat upon the top of a sink. Beneath the sink the shank of the sleeve carries an elastomeric washer which is positioned adjacent the bottom of the sink, a hard washer positioned adjacent the elastomeric washer, and a nut which is threaded onto the shank. The nut urges the hard washer against the seal washer and the seal washer in turn forms a seal with the bottom of the sink.

2 Claims, 1 Drawing Sheet

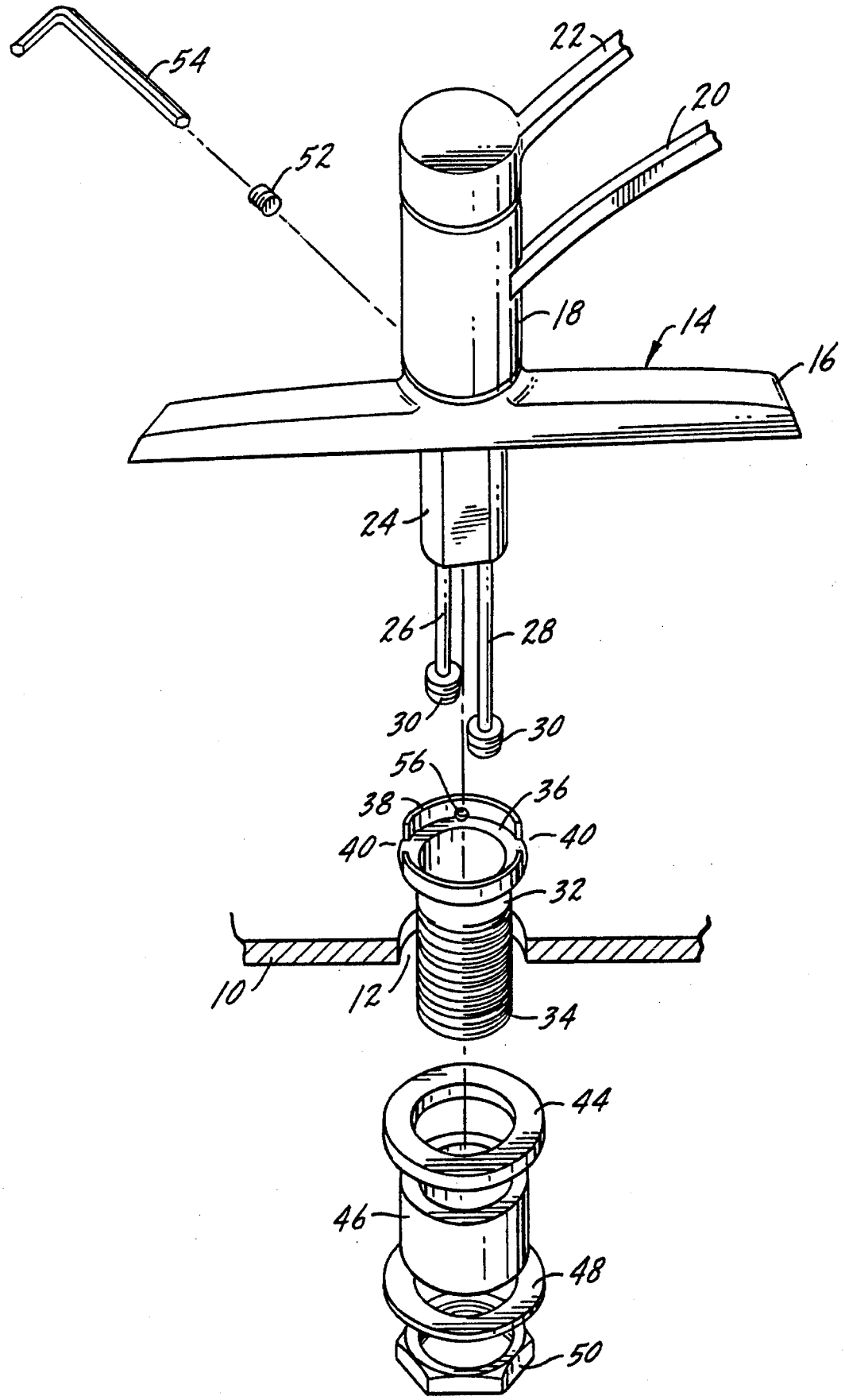
54
52
22
20
18
14
16
24
26
28
30
30
56
38
36
40
40
32
10
12
34
44
46
48
50

KITCHEN FAUCET TOP MOUNT DEVICE

THE FIELD OF THE INVENTION

The mounting of faucets, particularly kitchen faucets, to sinks which are already counter mounted is a cumbersome and difficult job. It also requires substantial work on the part of the installer in a confined and cramped area beneath the sink. The present invention is concerned with a simplified mounting device to provide for the mounting of a faucet to a sink where the sink is already installed in a counter, although the invention could also be used to mount a faucet to a sink prior to counter installation. The device is simple in form and reliable and can be quickly mounted to the conventional opening in the sink deck after which the faucet is passed through and locked to the mounting device.

SUMMARY OF THE INVENTION

The present invention relates to a device for quickly and reliably mounting a faucet, for example a kitchen faucet, to the deck of a sink which is already installed in a counter.

A primary purpose of the invention is a mounting device including a minimum of elements which may be used to provide a simplified attachment for a kitchen faucet.

Another purpose of the invention is a faucet mounting device which requires minimum time and effort by the installer in the area beneath the sink deck.

Other purposes will appear in the ensuing specification, drawing and claims.

BRIEF DESCRIPTION OF THE DRAWING

The invention is illustrated diagrammatically in the attached exploded perspective of the sink mounting device of the present invention.

DESCRIPTION OF THE PREFERRED EMBODIMENT

Faucets, particularly kitchen faucets, are often mounted onto sinks after the sinks have been pre-installed in a counter top. In such a situation, the prevailing practice requires that the faucet installer work in a cramped, confined area beneath the sink deck and make all the necessary connections from this area. The present invention provides a simplified means for attaching a faucet to a mounted sink and requires little time and effort by the installer in the area beneath the sink deck.

In the drawings, a typical sink deck is indicated at 10 and has an opening 12 for the mounting of the faucet. Although the invention will be described in connection with the mounting of a kitchen faucet, the concept disclosed and the device disclosed are equally applicable to the mounting of a lavatory faucet.

A typical kitchen faucet is indicated at 14 and has an escutcheon 16, a movable hub 18, with a spout 20 extending outwardly therefrom. The handle of the faucet is indicated at 22. Within the faucet there is a body, which in a single lever faucet of the type disclosed contains a mixing valve, often in cartridge form. The body which contains the cartridge extends downwardly from the escutcheon and is indicated at 24. The hot and cold water inlet conduits for the faucet are indicated at 26 and 28, with each having a threaded connector 30 at the bottom thereof for attachment to the conventional hot and cold water inlet pipes.

Positioned within the opening 12 is a sleeve 32 which has a threaded shank 34 and an outwardly-extending shoulder 36. There is an upstanding wall 38 at the extremity of shoulder 36 which extends partially about the circumference of the shoulder. There are diametrically spaced openings 40 in the upstanding wall 38 so as to properly locate the faucet when it is installed on top of the sleeve 32.

When the faucet is to be installed, the first step will be to insert the sleeve 32 in the opening 12. The threaded shank 34 of the sleeve will extend down beneath the bottom of the sink deck 10. An elastomeric seal element or washer 44 will then be placed on the threaded shank 34 and will be pushed up against the bottom of the sink deck 10. Next, a cylindrical spacer 46, if required, will be slid over the shank to the point where it is in contact with the underside of the seal washer 44. Next, a hard washer 48, which may be metal, is slid onto the shank 34 and pushed up against the bottom of the spacer 46. Finally, a nut 50 will be threaded onto the shank by the installer and will be snugged up tight against the bottom of hard washer 48 which in turn will force the top of the seal element 44 in sealing contact with the bottom of the sink deck 10. This completes the installation of the sleeve 32 onto the sink deck and as can be seen there is only a minimum of effort and time required by the installer for work beneath the sink deck.

Once the sleeve 32 has been attached to the sink deck as described, the faucet 14 will be positioned on top of the sleeve 32 and the faucet body 24 and the inlet conduits 26 and 28 will pass through the interior of sleeve 32. In this connection, the interior diameter of the sleeve must be sufficient to accommodate the faucet body and the inlet connections. Once the faucet has been so mounted and the openings 40 between the portions of the upstanding wall 38 are used to properly locate the faucet in the correct position on the sink deck, then the faucet will be attached to the sleeve by the use of a set screw 52 which can be attached by an allen wrench 54. The set screw will pass through the escutcheon 16 which seats upon the sleeve 32 and into an aligned opening 56 in the upstanding wall 38 of the sleeve 32. The set screw is shown in the drawing as being diagrammatically positioned for installation in the upper portion of the drawing.

Of importance in the invention is the simplified construction of the assembly of elements for reliably and quickly fastening a faucet to a sink deck when the sink is previously installed in a counter. There are a minimum number of elements and they may be easily attached by the sink installer to the sleeve 32 once it has been properly positioned within the opening in the sink deck.

Whereas the preferred form of the invention has been shown and described herein, it should be realized that there may be many modifications, substitutions and alterations thereto.

The embodiments of the invention in which an exclusive property or privilege is claimed are defined as follows:

1. A faucet and a device for mounting the faucet from the top of a sink including a generally cylindrical sleeve having a threaded shank with an internal diameter of a size to receive the faucet body and the water connections thereto, said sleeve having an outwardly extending shoulder at one end thereof, which shoulder is formed and adapted to seat upon the top of a sink, an upstanding wall extending at least in part about the outer extremity of said shoulder, a portion of the faucet body being positioned within said upstanding wall, a locking opening in said upstanding wall, a locking screw extending through the faucet and into the upstanding wall locking opening to fasten the faucet to the sleeve and to prevent relative movement therebetween.

2. The faucet and mounting device of claim 1 wherein there is a spacer positioned on said shank between and in end contact with an elastomeric seal element and a hard washer.

* * * * *